United States Patent [19]

Koshigoe

[11] 4,207,491

[45] Jun. 10, 1980

[54] ELECTRON GUN ASSEMBLY

[75] Inventor: Shinpei Koshigoe, Fukaya, Japan

[73] Assignee: Tokyo Shibaura Electric Co., Ltd., Kawasaki, Japan

[21] Appl. No.: 889,506

[22] Filed: Mar. 23, 1978

[30] Foreign Application Priority Data

Mar. 28, 1977 [JP] Japan ..... 52-33336

[51] Int. Cl.[2] ..... H01J 29/51

[52] U.S. Cl. ..... 313/412

[58] Field of Search ..... 313/412, 414, 411

[56] References Cited

U.S. PATENT DOCUMENTS

| | | | |
|---|---|---|---|
| 2,859,378 | 11/1958 | Gundert et al. | 313/414 X |
| 3,772,554 | 11/1973 | Hughes | 313/412 |
| 3,906,279 | 9/1975 | Linssen | 313/412 X |
| 3,932,786 | 1/1976 | Campbell | 313/414 X |
| 3,973,161 | 8/1976 | Van Leeuwen et al. | 313/409 |
| 3,984,723 | 10/1976 | Gross et al. | 313/412 |

*Primary Examiner*—Palmer C. Demeo

*Attorney, Agent, or Firm*—Cushman, Darby & Cushman

[57] ABSTRACT

An in-line type electron gun assembly for a color picture tube which is designed to emit a central electron beam and two side electron beams running along both sides of the central electron beam and can suppress coma aberration, thereby providing a highly resolved color picture and enable a high quality color picture tube to be manufactured at a low cost, and wherein a main convergence electrostatic lens is formed by a pair of serially arranged electrode means whose components are formed integrally to handle the respective electron beams; at least one of the paired electrode means is composite electrode consisting of a plurality of electrode plates each bored with three openings corresponding to said electron beams; and the axes of both side openings of the respective electrode plates of at least the composite one of said electrode means are displaced from the axis of the central electron beam at a progressively larger rate according as the position of the respective electrode plates is drawn nearer to the phosphor screen.

6 Claims, 10 Drawing Figures

ELECTRON GUN ASSEMBLY

BACKGROUND OF THE INVENTION

This invention relates to an electron gun assembly, and more particularly to improvements on an in-line type electron gun assembly formed of a plurality of electron guns emitting a plurality of electron beams.

An in-line type electron gun assembly used for a color picture tube is generally constructed as illustrated in FIG. 1. The electron gun assembly 11 comprises a first electrode 1, a second electrode 2, a third electrode 3, a fourth electrode 4 and cathodes 5R, 5G, 5B. The cathodes 5R, 5G, 5B emit a red electron beam 6R, a green electron beam 6G and a blue electron beam 6B respectively. These electron beams 6R, 6G, 6B pass through the holes of a shadow mask 7 and impinge on a phosphor screen 8.

With the electron gun assembly constructed as described above, the conventional process of converting three red, green and blue electron beams 6R, 6G and 6B at one point on the shadow mask 7 is to refract both side electron beams, that is, a red electron beam 6R and a blue electron beam 6B to the central green electron beam 6G at a convergence angle 9 at the fourth electrode 4. This arrangement is carried out by causing the axis 4C of both side holes of the fourth electrode 4 to be displaced from the axis of the central green electron beam 6G at a larger rate than that at which the axis 3C of both side holes of the third electrode 3 is set apart from the axis of the central green electron beam 6G. There will now described by reference to the red electron gun 5R of FIG. 2 the principle by which the abovementioned arrangement can be attained. The red electron beam 6R does not pass exactly along the axis of the thick main electrostatic lens (formed of the third and fourth electrodes 3R, 4R overlapping each other), but along a line slightly displaced from said lens axis. Therefore, the red electron beam 6R is refracted downward at the fourth electrode 4. This downward refraction results from the optical principle illustrated in FIG. 5. A light beam 21 passes through a point slightly displaced from the center of, for example, a single convex glass lens 20 and consequently is refracted.

The convergence angle 9 which should be taken into account in designing a color picture tube is defined by causing the axes of both side holes of, for example, the third and fourth electrodes to be properly displaced from the axis of the central green electron beam 6G. In this case, the red electron beam 6R is sharply refracted by the main electrostatic lens formed of the third and fourth electrodes 3R, 4R. Therefore, the red electron beam 6R (also blue electron beam 6B) tends to be readily affected by the broadly defined spherical aberration, particularly coma abberration. As the result, a red electron beam image takes a tadpole trailing form 10R on the phosphor screen 8. A prior art attempt to reduce the coma aberration was to bulge the plane of the fourth electrode 4 parallel to the surface of the drawing as viewed in the vertical direction to relieve the sharp refraction of an electron beam, thereby enabling the image of said electron beam to approximate the true round form 10G of the central green electron beam 6G. However, the abovementioned proposed process which renders the image subject to strong distortion essentially presents difficulties in decreasing the effect of the coma aberration.

SUMMARY OF THE INVENTION

It is accordingly the object of this invention to provide an electron gun assembly, wherein the process of converging electron beams is improved to provide a highly resolved color picture by elimination of the effect of coma aberration, and the steps of manufacturing parts are decreased in number, thereby enabling a high quality color picture tube to be produced at a low cost.

According to an aspect of this invention, there is provided an in-line electron gun assembly for color picture tube emitting a central electron beam and side electron beams running along both sides of the central electron beam, wherein a main convergence electrostatic lens is formed by a pair of serially arranged electrode means whose components are formed integrally to handle the respective electron beams; at least one of the paired electrode means is composite electrode consisting of a plurality of electrode plates each bored with three openings corresponding to said electron beams; and the axes of both side openings of the respective electrode plates of at least the composite one of said electrode means are displaced from the axis of the central electron beam at a progressively larger rate according as the position of the respective electrode plates is drawn nearer to the phosphor screen.

DESCRIPTION OF THE PREFERRED EMBODIMENTS

There will now be described by reference to the accompanying drawings the arrangement and operation of an electron gun assembly embodying this invention.

Figure 1:
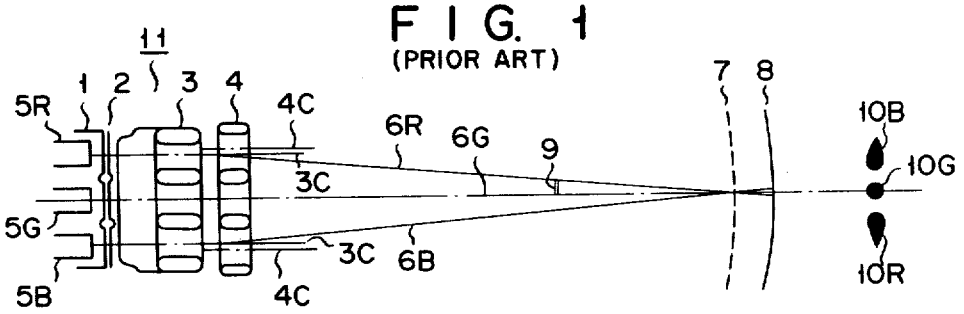
FIG. 1 (PRIOR ART)
FIG. 1 schematically illustrates the arrangement of the prior art electron gun assembly.
Figure 2:
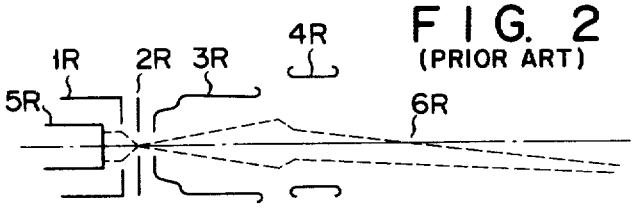
FIG. 2 (PRIOR ART)
FIGS. 2 and 5 indicate the principle on which the electron gun assembly of FIG. 1 is based.
Figure 3:
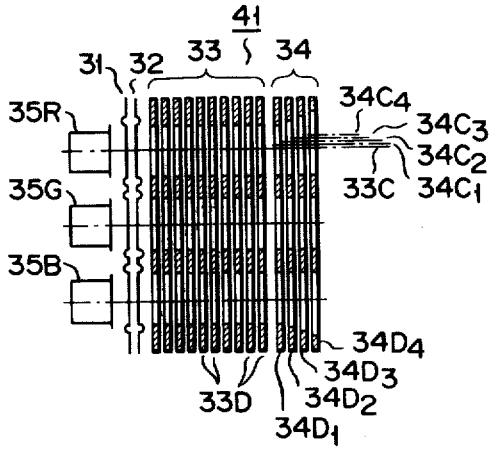
FIG. 3 is a cross sectional view of an electron gun assembly according to one embodiment of this invention.

Referring to FIG. 3, an electron gun assembly 41 comprises a first electrode 31, second electrode 32, third composite electrode 33, fourth composite electrode 34, cathode 35R, cathode 35G and cathode 35B. The cathodes 35R, 35G, 35B emit a red electron beam, a green electron beam and a blue electron beam respectively. The third composite electrode 33 is formed of a plurality of electrode plates 33D arranged in parallel at the same space and bored with three openings. The fourth composite electrode 34 is formed of a plurality of electrode plates $34D_1$, $34D_2$, $34D_3$, $34D_4$ similarly arranged in parallel at the same space and respectively bored with three openings.

With the electron gun assembly of FIG. 3, the axes of the central and both side openings of the first, second and third electrodes 31, 32, 33 coincide with those of the three electron guns, as in the prior art electron gun assembly. However, the axes of both side openings of the electrode plates of the fourth composite electrode 34 corresponding to the red and blue electron guns respectively are set in different positions from the conventional case. Namely, with the electrode plate $34D_1$ of the fourth composite electrode 34 which lies nearest to the third composite electrode 33, the side opening corresponding to, for example, the cathode 35R has its axis $34C_1$ displaced from the axis of the central green electron gun at a slightly larger rate than that at which the axis 33C of the side opening of the third composite electrode 33 similarly corresponding to the cathode 35R is set apart from the axis of the central green electron gun. The axes $34C_2$, $34C_3$, $34C_4$ of the side openings (corresponding to, for example, the cathode 35R) of the electrode plates $34D_2$, $34D_3$, $34D_4$ of the fourth composite electrode 34 are deflected from the axis of the central green electron gun at a progressively larger rate than that at which the aforesaid axis $34C_1$ of the side opening of the fourth composite electrode 34 is set apart from the axis of the central green electrode gun. The rate at which the axis of the side opening (corresponding to, for example, the cathode 35R) of the last electrode plate $34D_4$ of the fourth composite electrode 34 is displaced from the axis of the central green electrode gun is not particularly defined, but should preferably be the same as or slightly smaller than in the prior art case.

Figure 4:
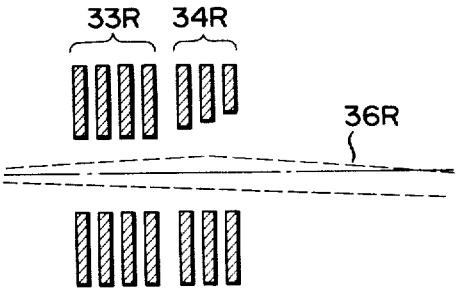
FIGS. 4 and 6 set forth the principle on which the electron gun assembly of this invention shown in FIG. 3 is based.
Figure 5:
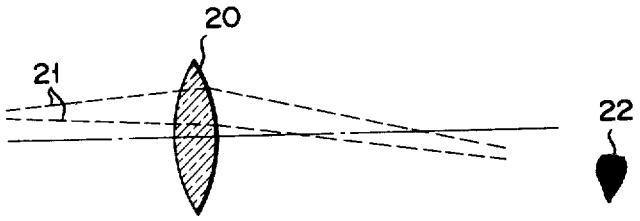
FIG. 5 (PRIOR ART)
Figure 6:
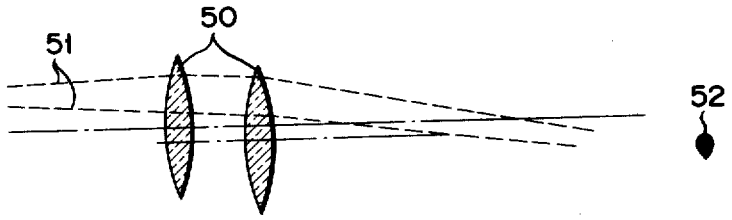

FIG. 4 shows the orbit along which a red electron beam 36R emitted from a red electron gun included in the electron gun assembly of this invention arranged as described above is made to travel. FIG. 6 also optically exemplifies the orbit of said red electron beam 36R. A main convergence electrostatic electron lens for a red electron beam formed of the third composite electrode 33R and fourth composite electrode 34R may be regarded as a combination of thin lenses 50 (two units shown in FIG. 6). In the case of FIG. 6, a light beam 51 indicated in broken lines is taken to travel along substantially the same route as in the case of the red electron beam 36R of FIG. 4. Like the light beam 51 of FIG. 6, a red electron beam 36R of FIG. 4 is not sharply refracted by a single thick lens, but is gently deflected while passing through a plurality of thin lenses. Therefore, the red electron beam 36R, for example, is little affected by coma aberration, thereby, as seen from FIG. 6, enabling a bright spot on the phosphor screen 8 to indicate a far less noticeable comet-like tail pattern.

With the electron gun assembly of this invention constructed as described above, all red, green and blue electron beams indicate a bright spot substantially shaped like a true circle, providing a color picture tube having a high resolving power.

Unlike the prior art cylindrical electrode difficult of fabrication and alignment, the third composite electrode 33 and/or the fourth composite electrode 34 which is formed of a plurality of perforated electrode plates can be easily molded, for example, by a press and further admits of easy alignment by the peripheral portion, leading to a noticeable decline in a number of manufacturing steps and production cost. Consequently, it has become possible to provide an inexpensive high quality color picture tube.

Figure 7:
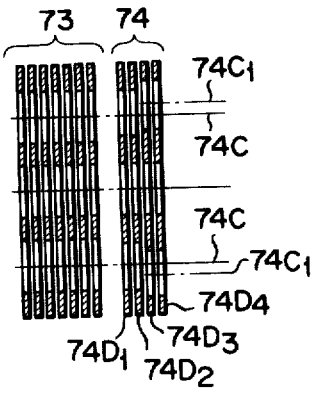
FIGS. 7, 8 and 9 are cross sectional views of an electron gun assembly according to other embodiments of this invention.

The foregoing embodiment refers to the case where the axes of both side openings of the electrode plates of the fourth composite electrode 34 were displaced from the axis of the central green electrode at a progressively larger rate. However, such arrangement is not always required. As shown in FIG. 7 for example, it is possible to align the axes of both openings of the first two electrode plates $74D_1$, $74D_2$ of the fourth composite electrode 74 with those of the third composite electrode 73 and deflect the axes $74C_1$ of both side openings of the succeeding two electrode plates $74D_4$, $74D_4$ outward from the axis of the central green electron gun. Further, it is possible to deflect the axes of the respective side openings of two grouped electrode plates $83D_5$, $83D_4$ and those of two grouped electrode plates $83D_3$, $83D_2$ all of the third composite electrode 83 from the axes 83C of both side openings of the fourth composite electrode 84 finally to provide the axis $83C_1$ of both side openings of the electrode plates $83D_3$, $83D_2$, $83D_1$ of the third composite electrode 83. Also as seen from FIG. 9, it is possible to deflect the axes of the respective side openings of the electrode plates of the third composite electrode and those of the fourth composite electrode properly from the axis of the central green electron gun.

Figure 8:
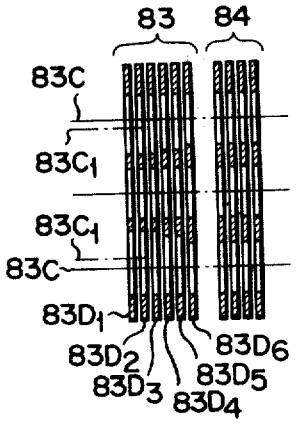
Figure 9:
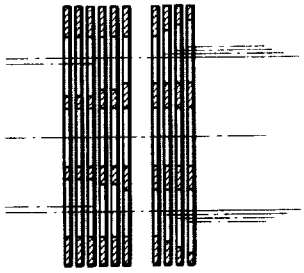

The diameters of all the openings of each electrode plate may be the same as in the case of the electrode plates of FIG. 7 or may be different from each other as in the case of the electrode plates of FIGS. 3, 8 and 9. Further, the opening need not take a truly round form, but may be made, for example, elliptic. Obviously, the center of the elliptic opening is constituted by the intersection of the larger and shorter diameters. In this case, it is preferred to cause the position of the larger diameter to align with the direction in which the axes of both side openings of the electrode plate are displaced from the axis of the central green electron beam and vary the length of said larger diameter in a degree proportioned to the rate at which the axes of said both openings are displaced from the axis of the central green electron beam.

Figure 10:
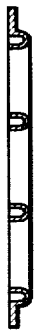
FIG. 10 illustrates an electrode plate usable with the electron gun assembly of this invention.

The perforated electrode plate need not be formed into a flat plate but may be shaped, as shown in the cross sectional view of FIG. 10, like a shallow dish, whose peripheral edge protrudes. The dish-like electrode plate can be easily molded by a press. One dish-like electrode plate which has the same effect as a plurality of flat electrode plates can decrease the weight and consequently cost of an electron gun assembly as a whole. With the foregoing embodiment, the respective electrode plates were spatially assembled in parallel, but should preferably be closely set side by side to prevent, for example, the turbulence of electron beams.

What is claimed is:

1. An in-line type electron gun assembly for color picture tube emitting a central electron beam and side electron beams running along both sides of the central electron beam comprising:

a main convergence electrostatic lens formed by a pair of serially arranged electrode means whose components are formed integrally to handle the respective electron beams;

at least one of the paired electrode means being a composite electrode consisting of a plurality of parallel mounted electrode plates each bored with three openings, one of said electron beams passing through each of said openings, respectively; and the axes of both side openings of the respective electrode plates of at least the composite one of said electrode means being displaced outward from the axis of the central electron beam at a progressively greater distance as the position of the respective electrode plate approaches the phosphor screen.

2. The electron gun assembly according to claim 1 wherein the axes of both side openings of each electrode plate are displaced outward from the axis of the central electron beam at a successively larger rate than those of the previous electrode plate as the position of the respective electrode plate approaches the phosphor screen.

3. The electron gun assembly according to claim 1, wherein the axes of both side openings of each of at least two grouped electrode plates included in a main convergence electrostatic electron lens are displaced outward from the axis of the central electron beam at a progressively larger rate than those of another group of said at least two electrode plates as the position of the respective electrode plate approaches the phosphor screen.

4. The electron gun assembly according to claim 1, wherein the electrode plate is formed flat.

5. The electron gun assembly according to claim 1, wherein the electrode plate is shaped like a shallow dish whose peripheral edge protrudes.

6. The electron gun assembly according to claim 1, wherein the opening of the electrode plate has a round form.

* * * * *